US011001348B2

(12) United States Patent
Yandow

(10) Patent No.: US 11,001,348 B2
(45) Date of Patent: May 11, 2021

(54) DEVICE FOR ATTACHING A SEAT TO A STAND-UP PADDLEBOARD AND RELATED SYSTEMS

(71) Applicant: Chris Yandow, New Fairfield, CT (US)

(72) Inventor: Chris Yandow, New Fairfield, CT (US)

( * ) Notice: Subject to any disclaimer, the term of this patent is extended or adjusted under 35 U.S.C. 154(b) by 6 days.

(21) Appl. No.: 16/535,853

(22) Filed: Aug. 8, 2019

(65) Prior Publication Data

US 2020/0047857 A1 Feb. 13, 2020

Related U.S. Application Data

(60) Provisional application No. 62/716,574, filed on Aug. 9, 2018.

(51) Int. Cl.

| | |
|---|---|
| ***B63B 32/77*** | (2020.01) |
| ***B63B 34/20*** | (2020.01) |
| ***B63B 32/70*** | (2020.01) |
| ***B63B 32/66*** | (2020.01) |
| ***B63B 34/26*** | (2020.01) |
| ***B63B 29/04*** | (2006.01) |

(52) U.S. Cl.

CPC ..... *B63B 32/77* (2020.02); *B63B 32/66* (2020.02); *B63B 32/70* (2020.02); *B63B 34/20* (2020.02); *B63B 34/26* (2020.02); *B63B 2029/043* (2013.01)

(58) Field of Classification Search

CPC ..... B63B 32/00; B63B 32/20; B63B 32/56; B63B 32/60; B63B 32/66; B63B 32/70; B63B 32/77; B63B 34/20; B63B 34/26; B63B 34/45; B63B 34/565; B63B 29/04; B63B 2029/43

USPC ..... D8/353, 354, 381; 248/229.15, 229.25, 248/228.6, 230.6, 231.71

See application file for complete search history.

(56) References Cited

U.S. PATENT DOCUMENTS

| | | | | | |
|---|---|---|---|---|---|
| 3,424,412 | A | * | 1/1969 | Gayle | B63H 20/007 248/642 |
| 3,425,127 | A | * | 2/1969 | Long | E04G 21/1808 33/406 |
| D215,141 | S | * | 9/1969 | Harmsen | D8/380 |
| D246,572 | S | * | 12/1977 | Walter | D8/354 |
| 4,752,261 | A | | 6/1988 | Zoya | |
| 4,784,011 | A | * | 11/1988 | Riley | B60R 1/061 248/479 |
| 4,857,025 | A | | 8/1989 | Brown et al. | |
| 4,865,572 | A | | 9/1989 | Andes | |

(Continued)

*Primary Examiner* — Ajay Vasudeva

(74) *Attorney, Agent, or Firm* — Ohlandt, Greeley, Ruggiero & Perle, L.L.P.

(57) ABSTRACT

Disclosed are devices for attaching a seat to a stand-up paddleboard. The devices generally have an open "C"-shape that is designed and configured to accommodate the side rail of a stand-up paddleboard while maintaining flush contact with at least a portion of the bottom of the stand-up paddleboard. The present disclosure also relates to a system for attaching a seat to a stand-up paddleboard. The system includes the above-described device and a mechanism for connecting the device to a seat disposed on the stand-up paddleboard. The mechanism for connecting the device to a seat can be, for example, a strap or a hook. The connecting device can be varied to accommodate the location on the seat to which the connecting device is attached.

19 Claims, 4 Drawing Sheets

(56) References Cited

U.S. PATENT DOCUMENTS

| | | | | |
|---|---|---|---|---|
| 5,064,162 | A * | 11/1991 | Jondelius | B60R 11/0241 248/548 |
| 5,290,196 | A | 3/1994 | Steel | |
| 5,651,706 | A | 7/1997 | Kasper | |
| D391,264 | S * | 2/1998 | Johansson | D14/253 |
| 6,035,799 | A | 3/2000 | Lukanovich et al. | |
| 6,357,713 | B1 * | 3/2002 | Bebow | F16M 13/02 248/300 |
| 6,925,955 | B1 | 8/2005 | Brooks | |
| 7,731,138 | B2 * | 6/2010 | Wiesner | F16M 11/24 248/160 |
| 8,752,492 | B1 | 6/2014 | Harris | |
| 9,027,501 | B2 | 5/2015 | Wood et al. | |
| 9,428,253 | B1 | 8/2016 | Morgan et al. | |
| D867,854 | S * | 11/2019 | De La Torre, IV | D8/354 |
| 2003/0019985 | A1 * | 1/2003 | Rogers | E04G 5/048 248/235 |
| 2015/0059637 | A1 | 3/2015 | Johns et al. | |

* cited by examiner

DEVICE FOR ATTACHING A SEAT TO A STAND-UP PADDLEBOARD AND RELATED SYSTEMS

BACKGROUND

1. Field of the Disclosure

The present disclosure relates to a device for attaching a seat to a stand-up paddleboard. The device is generally an "C"-shaped device that is designed and configured to accommodate the side rail of a stand-up paddleboard while maintaining flush contact with at least a portion of the bottom of the stand-up paddleboard. The present disclosure also relates to a system for attaching a seat to a stand-up paddleboard.

2. Description of Related Art

Countless people have discovered and enjoyed the pleasure and relaxation of paddle boarding. However, after standing and paddling for an extended amount of time, paddle boarders often get the urge to sit down to take a break from standing. Most boards have nicely padded decks that are relatively comfortable to sit on for short periods of time. Placing a seat of some type, such as a folding stool, makes it possible to stay on the water for much longer periods of time and makes it much more comfortable to sit compared to sitting on the deck of the paddleboard. It is also possible to paddle while sitting. Placing a folding beach chair on a paddleboard provides even more comfort since a chair has a back that can also recline. However, merely placing a stool or a chair on a paddleboard, though convenient, allows the stool or chair to move around easily and possibly fall off the board, especially in areas of boat traffic where wakes are created. Some attempts to solve the above problem have been made.

U.S. Pat. No. 9,428,253 provides a rowing device conversion kit for a stand-up paddleboard (SUP) that includes a frame assembly with seat tracks, a seat assembly with a rolling seat, and a rigger assembly. The frame assembly is attached to the SUP with four attachment clamps that each engage a portion of a rail of the stand-up paddleboard. The attachment clamps are generally of a C-shape so that, it is said, the clamps conform to the profile of the rails of the SUP. The C-shaped clamps are strapped to the frame assembly by wrapping straps completely around the frame, tightening the straps, and buckling the straps. A locking mechanism keeps the seat in place as the user is climbing on or off the SUP.

U.S. Patent Publication 2015/0059637 provides a station that can be strapped to a standup paddle board (SUP) using straps that can be hooked into an inner edge of a side indentation with an opposite end wrapped through a deck eye, such as a buckle, and the like, and have a hook and loop fasteners. The deck eye can be attached to a deck surface by a fastener with an adhesive layer. Alternatively, the upper ends of the straps can pass through side openings and into a middle of housing through an opposite side opening in the housing, with another end of the straps fastened to the deck surface in a similar manner as the deck eye fastener with an adhesive layer. The straps can be attached to side indentation edges, as above, or through sides of the housing, or the straps can pass over the top surface portions of the housing to generally clamp the housing to the SUP deck.

U.S. Pat. No. 6,035,799 provides a seat and foot rest assembly to convert a water-buoyant board, such as a surf board or sail board, into a kayak-type paddling craft. The assembly includes a chassis, connectors to secure the chassis to the top wall of the water-buoyant board, a seat secured to the rear portion of the chassis and a foot rest adjustably mounted on the front section of the chassis. The connectors include suction cups and board-encircling straps or screws to be screwed within screw inserts carried by the board top wall. The conversion kit is said to be easily be detached to allow the user to use the board in its original configuration.

It would be desirable to provide a device and system that provide at least the features of: (1) adaptability to a wide variety of seats; (2) secure attachment of the seat to the stand-up paddleboard; (3) easy attachment and removal of the seat from the stand-up paddleboard; and (4) essentially "tool-less" use. These and other benefits are found in the devices and systems of the present disclosure.

SUMMARY

In the disclosure that follows, some features may be discussed or shown separately, in one embodiment, or in combination with another particular feature or features. One skilled in the art will appreciate that the embodiments and features disclosed herein can be applicable to other embodiments and/or combined with other embodiments and/or other disclosed features. Thus, the particular embodiment in which any feature disclosed herein can be shown does not limit the feature to that particular embodiment. Those skilled in the art are capable of combining features or separating features from a combination, as desired.

None of the above potential solutions in the related art seems to provide the desired four (4) features mentioned. The disclosed device and system provide the adaptability and versatility of a quick "connect and release" device for attaching any one of a various number of seats to a stand-up paddleboard. The device is designed to secure the seat well enough so that it does not move while paddling or sitting. At the same time, the device is versatile such that the device can be used with any seat or stool that has at least one structural element, either vertical or horizontal in relation to the top surface of the stand-up paddleboard, to which the device can be attached using the disclosed connecting device. The device and system can be used to attach and detach the seat quickly to the stand-up paddleboard and can be attached and detached without the need for any tools. While the concepts may sound simple, experimentation showed that certain design features are important to ensure that once tension is applied to the connecting device, the device does not easily pull away from the rail of the stand-up paddleboard, thus reducing its security and safety.

The present disclosure relates to a device for attaching a seat to a stand-up paddleboard.

The present disclosure relates to such a device that is generally an "C"-shaped device designed and configured to accommodate the side rail of a stand-up paddleboard while maintaining flush contact with at least a portion of the bottom of the stand-up paddleboard.

The present disclosure also relates to a system for attaching a seat to a stand-up paddleboard.

The present disclosure further relates to such a system that comprises the above-described device and a mechanism for connecting the device to a seat disposed on the stand-up paddleboard with the mechanism for connecting the device to a seat can be, for example, a strap or a hook and the connecting device can be varied to accommodate the location on the seat to which the connecting device is attached.

The present disclosure still further provides such a system that may optionally include a mechanism for connecting two devices disposed on opposite sides of the stand-up paddleboard across the underside of the stand-up paddleboard.

A preferred feature of the disclosed device is that the device remains at least partially flush to the bottom of the stand-up paddleboard after tension is applied to the connecting device. This feature maintains the device secure and, at the same time, prevents whatever may be floating in the water from getting caught in the device which would make paddling less efficient. At the same time, the device design has universal application to almost any shaped stand-up paddleboard since the angles of tension holds the device securely to the stand-up paddleboard regardless of rail size and shape.

One embodiment of the present disclosure relates to a device for attaching a seat to a stand-up paddleboard, the device having a generally open "C"-shaped configuration comprising: a first end and a second end having a total length therebetween. The total length comprises: a first length starting at and comprising the first end connected to a second length through a first radius, a second length connected to a third length through a second radius with the third length connected through a third radius to a fourth length ending at and comprising the second end, wherein the first radius provides a substantially 90° angle between the first length and the second length, wherein the second radius provides an obtuse angle between the second length and the third length, and wherein the third radius provides an obtuse angle between the third length and the fourth length. The device may further comprise a first attachment location disposed and adapted to cooperate with a connecting device, wherein the first attachment location comprises a first opening disposed proximal the second end and passing through the fourth length. The first attachment location is disposed and configured to allow the device to connect to a seat device by a connecting mechanism that can attach to a vertical or horizontal element of the seat. The device may further comprise a second attachment location disposed and adapted to cooperate with a connecting device, wherein the second attachment location comprises a second opening disposed proximal the first end and passing through the first length. The second attachment location is disposed and configured to allow the device to connect to another device by a connecting mechanism across the underside of the stand-up paddleboard.

A second embodiment of the present disclosure relates to a system for attaching a seat to a stand-up paddleboard, the system comprising: a device having a generally open "C"-shaped configuration comprising: a first end and a second end having a total length therebetween, wherein the total length comprises: a first length starting at and comprising the first end connected to a second length through a first radius; the second length connected to a third length through a second radius; the third length connected through a third radius to a fourth length ending at and comprising the second end, wherein the first radius provides a substantially 90° angle between the first length and the second length, wherein the second radius provides an obtuse angle between the second length and the third length, and wherein the third radius provides an obtuse angle between the third length and the fourth length; and a first attachment location that comprises a first opening disposed proximal the second end and passing through the fourth length, wherein said first opening is disposed and adapted to cooperate with a connecting device; and a connecting device attached to the first attachment location, wherein the connecting device is configured to attach to an element of a seat. The device may further comprise a second attachment location disposed and adapted to cooperate with a connecting device, wherein the attachment location comprises a second opening disposed proximal the first end and passing through the first length. The second attachment location is disposed and configured to allow the device to connect to another device by a connecting mechanism across the underside of the stand-up paddleboard.

The device can also include padding in areas where the device contacts the stand-up paddleboard to provide protection to the stand-up paddleboard from scratching by the device.

DETAILED DESCRIPTION OF PREFERRED EMBODIMENTS

Preferred embodiments of the present disclosure as well as options thereof will now be described in conjunction with the Figures, in which like numerals denote like elements. With respect to the Figures that follow, certain angles are described. It will be understood that the described angels are such that adjacent "lengths" (as the term "length" is used in conjunction with the Figures) will be angled in such a way as to form a "C"-shaped configuration. Stated otherwise, each angle is either clockwise or counter-clockwise to its adjacent angles. In this way, the correct "C"-shaped configuration is formed.

Figure 1:
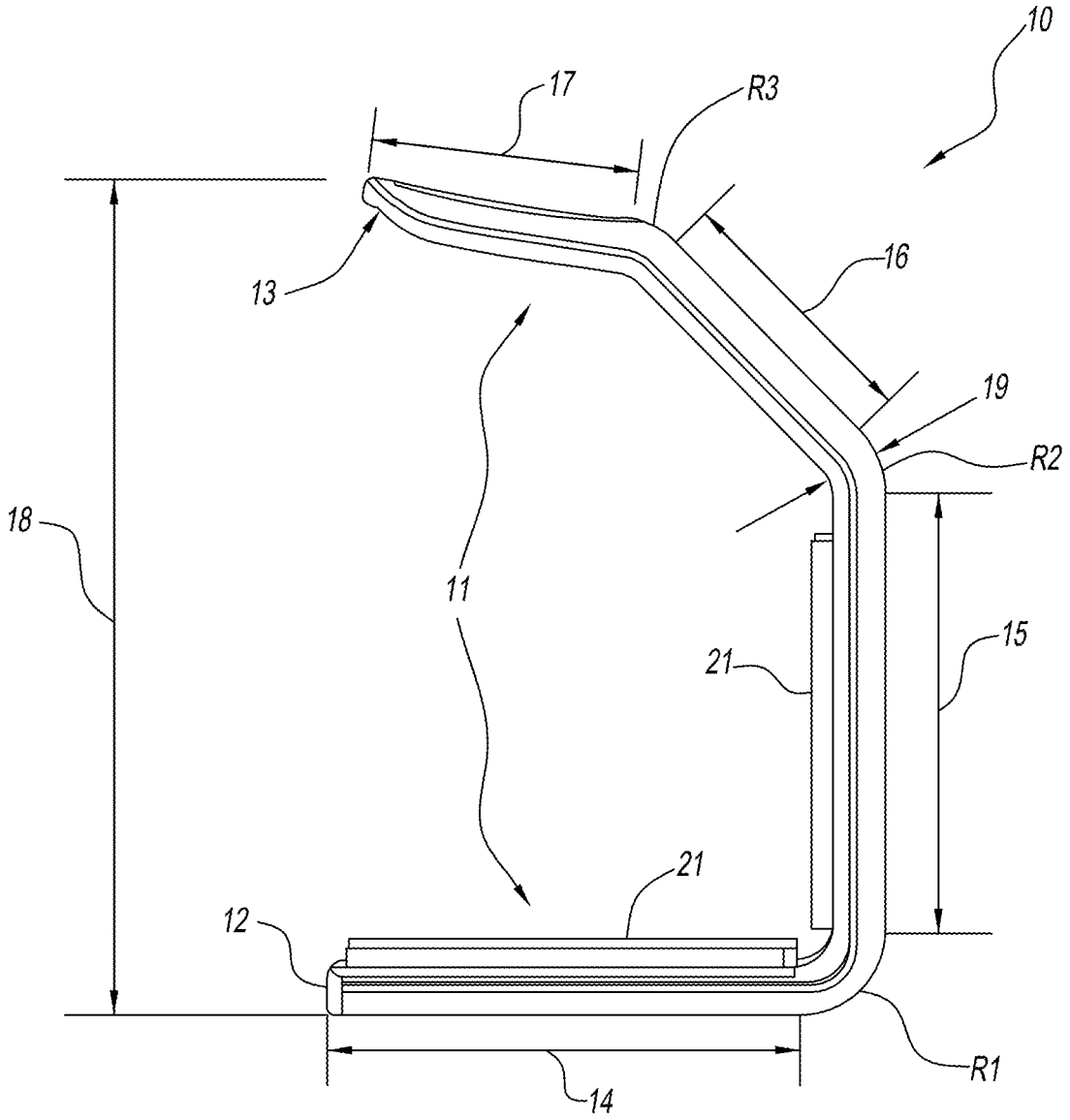
FIG. 1 shows a side view of one embodiment of the device according to the present disclosure.

FIG. 1 shows a first embodiment of a device 10 according to the present disclosure. In FIG. 1, device 10 is a generally open "C"-shaped configuration 11 having a first end 12 and a second end 13. From first end 12, device 10 has a first length 14 that connects to a second length 15 through a radius R1. In the embodiment shown in FIG. 1, radius R1 provides an angle between first length 14 and second length 15 that is from about 85° to about 95°, preferably from about 87° to about 93°, and more preferably about 90°. First length 14 can be from about 3½ inches to about 5½ inches, preferably from about 4 inches to about 5½ inches, more preferably from about 5 to about 5½ inches. In the specific embodiment shown in FIG. 1, first length 14 is 5½ inches. Also, second length 15 can be any length sufficient to span the depth of the stand-up paddleboard, but is generally from about 3 inches to about 6 inches, preferably from about 4 inches to about 6 inches and most preferably from about 5 inches to about 6 inches. In the specific embodiment shown in FIG. 1, second length 15 is 5¼ inches. Second length 15 connects to third length 16 through a radius R2 that provides an obtuse angle between second length 15 and third length 16. Radius R2 provides an angle between second length 15 and third length 16 that is from about 135° to about 170°, preferably from about 145° to about 165°. In the embodiment shown in FIG. 1, radius R2 provides an angle between second length 15 and third length 16 that is about 160°. Third length 16 connects to fourth length 17 through a radius R3 that provides an obtuse angle between third length 16 and fourth length 17. Third length 16 can be from about 2 inches to about 4 inches, preferably from about 2 inches to about 3½ inches and most preferably about 3 inches to about 3½ inches. In the specific embodiment shown in FIG. 1, third length 16 is 3¼ inches. Radius R3 provides an angle between third length 16 and fourth length 17 that is from about 135° to about 170°, preferably from about 145° to about 165°. In the embodiment shown in FIG. 1, radius R3 provides angle between third length 16 and fourth length 17 that is about 160°. Fourth length 17 can be from about 2 inches to about 4 inches, and preferably from about 2½ inches to about 3½ inches. In the specific embodiment shown in FIG. 1, fourth length 17 is 3 inches.

Also, as shown in the embodiment in FIG. 1, first length 14 and fourth length 17 are not parallel to each other, with fourth length 17 disposed slightly away from parallel vis-à-vis first length 14. Moreover, in the embodiment shown in FIG. 1, first end 12 and a second end 13 are separated by a distance 18. Distance 18 can be from about 7 inches to about 9 inches, and preferably from about 7½ inches to about 9 inches. In the embodiment shown in FIG. 1, distance 18 is 8⅞ inches. Device 10 also has a thickness 19, that can depend on the material of which device 10 is made. In the embodiment shown in FIG. 1, thickness 19 is about ¼ inch. As mentioned above, device 10 can optionally include pads 21, with pads 21 preferably disposed on the sides of lengths 14 and 15 so as to contact the stand-up paddleboard to protect the surface of stand-up paddleboard from scratching.

Figure 2:
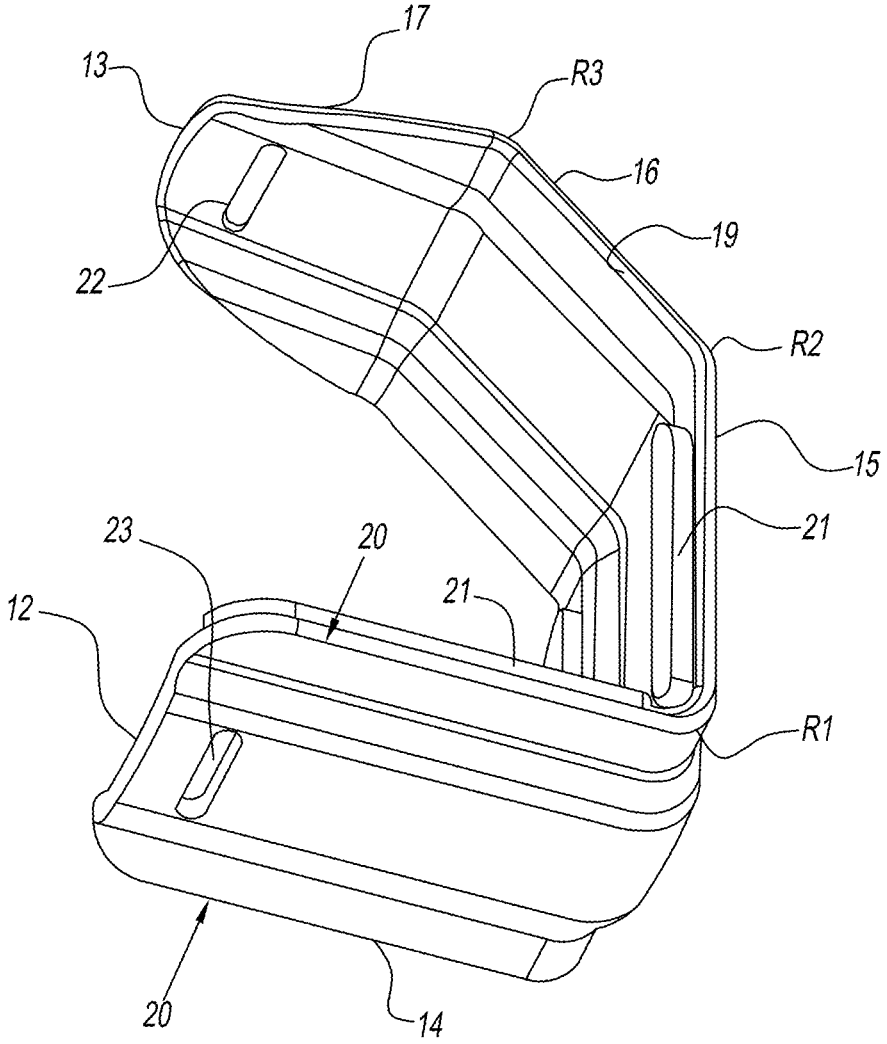
FIG. 2 shows a bottom perspective view of the device shown in FIG. 1.

FIG. 2 shows a bottom perspective view of device 10 and all elements are identical to device 10 shown in FIG. 1. Thus, everything that has been described with respect to FIG. 1 applies equally to device 10 of FIG. 2.

FIG. 2 shows device 10 in a perspective view, so that a width 20 of device 10 can be seen. In general, width 20 can be from about 2 inches to about 4 inches, preferably from about 2½ inches to about 3½ inches. In the specific embodiment shown in FIGS. 1 and 2, width 20 is 3 inches. Again, as with thickness 19, width 20 can depend upon the material of which device 10 is made.

Also shown in FIG. 2 are first opening 22 and second opening 23 that have been described above. First opening 22 is disposed proximal the second end 13 and passes through the fourth length 17, and first opening 22 is disposed and configured to cooperate with a first connecting device 32 (see, e.g. FIG. 3) configured to attach to an element of a seat. It should be recognized that first opening 22 is not required since a connecting device could be attached to device 10 by other means such as a rivet or screw. Second opening 23 is disposed proximal the first end and passes through first length 14, and second opening 23 is disposed and configured to allow device 10 to connect to another device 10 by a second connecting device (not shown) such as a strap or cord that spans the underside of the stand-up paddleboard. It should be recognized that second opening 23 is not required since second connecting device (not shown) could be attached to device 10 by other means such as a rivet or screw.

Figure 3:
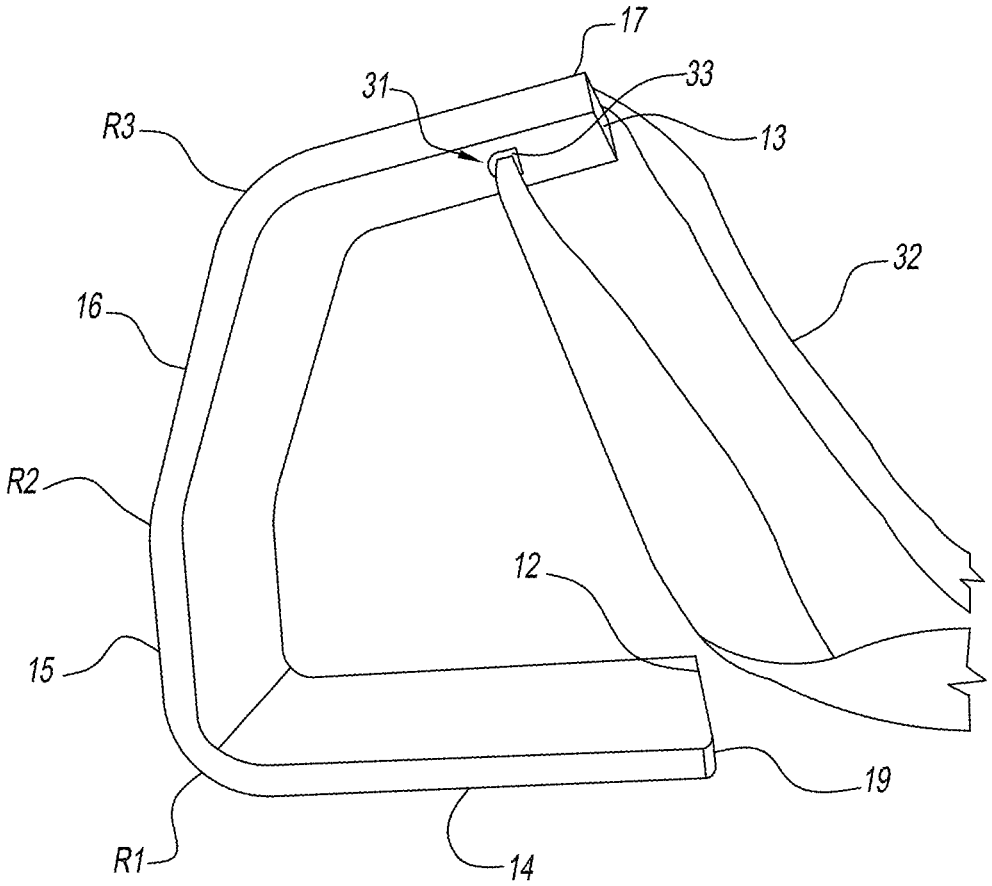
FIG. 3 shows a perspective view of an embodiment of a device according to the present disclosure, with an embodiment of the first connecting device according to the present disclosure attached thereto.

FIG. 3 shows device 10 that further includes an attachment location 31 disposed and adapted to cooperate with a connecting device 32. In the embodiment shown in FIG. 3, attachment location 31 comprises a slot 33 disposed proximal second end 13 and passing through fourth length 17. Attachment location 31 is thus disposed substantially opposite first length 14 such that when connecting device 32 is connected to a seat 40 (see FIG. 4), first length 14 is, preferably, urged flat against a bottom side of a stand-up paddleboard. As will be discussed in conjunction with FIG. 4, connecting device 32 in the embodiment shown is a strap suitable for wrapping around a horizontal or vertical element of seat 40. Although attachment location 31 is shown in FIG. 3 as slot 33 in fourth length 17 through which connecting device 32 is passed, it will be understood that attachment location 31 can be any one of a number of alternatives, such as a snap element attached to an upper surface of, or through, fourth length 17, a ring element attached to an upper surface of, or through, fourth length 17 or any other such element designed and configured to cooperate with one or both ends of connecting device 32. In the embodiment shown in FIG. 3, slot 33 is disposed proximal second end 13 of device 10. Slot 33 can be disposed at any distance from second end 13, but preferably is disposed from about ½ inch to about 2 inches from second end 13, and preferably from about ½ inch to about 1½ inches from second end 13.

Figure 4:
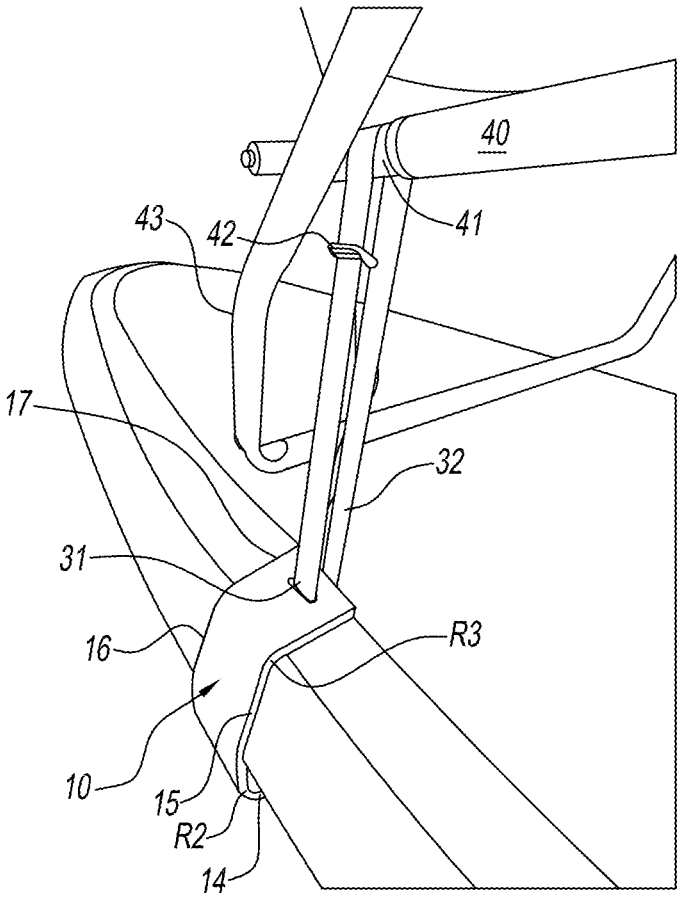
FIG. 4 shows an overhead perspective view of the embodiment of a device according to the present disclosure shown in FIG. 3 attached to a cross-member of a folding seat disposed on the top of a stand-up paddleboard.

FIG. 4 shows device 10 of FIG. 3 connected with a horizontal element 41 (i.e. a side rail of seat 40) using connecting device 32. As shown in FIG. 4, connecting device 32 is an adjustable strap having an adjustment/locking buckle 42. As will be appreciated, connecting device 32 can also be engaged with a vertical element 43 (i.e., a leg of a seat 40) depending on preference and the style of stand-up paddleboard. Also, connecting device 32 can be folded back upon, and connected to, itself using a loop and hook fastener, such as Velcro® (not shown in FIG. 4) for added security. As seen in the embodiment shown in FIG. 4, radii R1, R2 and R3 are configured so that when connecting device 32 is connected to horizontal element 41, first length 14 is urged against the bottom side of the stand-up paddleboard. It will be understood that any number of devices 10 and connecting devices 32 may be used to secure seat 40 to a stand-up paddleboard. However, preferably, at least two such devices 10 and two such connecting devices 32 should be used to stabilize at least side-to-side movement of seat 40 on the top surface of the stand-up paddleboard.

It should be noted that the terms "first", "second", "third", "upper", "lower", "front", "rear" and the like may be used herein to modify various elements. These modifiers do not imply a spatial, sequential, or hierarchical order to the modified elements unless specifically stated. Also, it should be understood that where certain materials are mentioned as useful in making one or more of the elements of any embodiment of the present disclosure, it will be understood by those of skill in the art that the selection of material is a mere matter of design choice and/or of the necessary physical attributes of any particular element.

It should also be noted that terms such as "substantially" or "about" will be understood by those of skill in the art such that there is no lack of clarity or indefiniteness in their use. In any event, without being restricted to strict numerical parameters, will be understood that terms such as "substantially" or "about" as used herein should be understood to mean the stated amount or numerical identification plus or minus 10%, preferably plus or minus 5%, more preferably plus or minus 1%, and most preferably plus or minus less than 1%.

While the present disclosure has been described with reference to one or more exemplary embodiments, it will be understood by those skilled in the art that various changes may be made to the exemplary embodiments, and that equivalents may be substituted for elements thereof, without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated, but that the disclosure will include all embodiments falling within the scope of the appended claims.

All of the patents and patent publications referred to herein are Incorporated herein by reference as if fully set forth verbatim in this disclosure.

What is claimed is:

1. A system for attaching a seat to a stand-up paddleboard, the system comprising:

a device having a generally open "C"-shaped configuration comprising:

a first end and a second end having a distance therebetween, wherein the distance comprises:

a first length starting at and comprising the first end connected to a second length through a first radius;

the second length connected to a third length through a second radius;

the third length connected through a third radius to a fourth length ending at and comprising the second end, wherein the first radius provides a substantially 90° angle between the first length and the second length, wherein the second radius provides an obtuse angle between the second length and the third length, and wherein the third radius provides an obtuse angle between the third length and the fourth length;

an opening disposed proximal the second end; and a flexible strap extending through the opening, wherein the flexible strap is adjustable in length.

2. The system according to claim 1, wherein the opening is disposed from about ½ inch to about 2 inches from second end.

3. The system according to claim 2, wherein the opening is disposed from about ½ inch to about 1½ inches from second end.

4. The system according to claim 1, wherein the device has a width of from about 2 inches to about 4 inches.

5. The system according to claim 4, wherein the width is from about 2½ inches to about 3½ inches.

6. The system according to claim 1, wherein the first end and the second end are separated by a distance from about 7 inches to about 9 inches.

7. The system according to claim 6, wherein the first end and the second end are separated by a distance from about 7½ inches to about 9 inches.

8. The system according to claim 1, further comprising pads disposed on the device so as to contact the stand-up paddleboard.

9. The system according to claim 1, wherein the first radius is from about 85° to about 95°.

10. The system according to claim 9, wherein the first radius is about 90°.

11. The system according to claim 1, wherein the first length is from about 3½ inches to about 5½ inches.

12. The system according to claim 1, wherein the second length is from about 3 inches to about 6 inches.

13. The system according to claim 12, wherein the second length is from about 4 inches to about 6 inches.

14. The system according to claim 1, wherein the second radius is from about 135° to about 170°.

15. The system according to claim 1, wherein the third length is from about 2 inches to about 4 inches.

16. The system according to claim 15, wherein the third length is from about 2 inches to about 3½ inches.

17. The system according to claim 1, wherein the third radius is from about 135° to about 170°.

18. The system according to claim 17, wherein the third radius is from about 145° to about 165°.

19. The system according to claim 1, wherein the fourth length is from about 2 inches to about 4 inches.

* * * * *